US005863102A

United States Patent [19]

Waguespack et al.

[11] Patent Number: 5,863,102

[45] Date of Patent: Jan. 26, 1999

[54] METHOD AND APPARATUS TO PERMIT ATTACHMENT OF BRISTLES TO TOOTHBRUSHES WITH RESILIENTLY FLEXIBLE HEADS AND TO THEREAFTER PERMIT THE TRIMMING AND END ROUNDING OF SUCH BRISTLES

[75] Inventors: Kenneth Gerald Waguespack, North Brunswick; Douglas J. Hohlbein, West Trenton, both of N.J.

[73] Assignee: Colgate-Palmolive Company, New York, N.Y.

[21] Appl. No.: 881,735

[22] Filed: Jun. 24, 1997

[51] Int. Cl.[6] ..... A46D 3/08; A46D 9/02; B25B 1/20

[52] U.S. Cl. ..... 300/11; 300/10; 300/17; 300/21

[58] Field of Search ..... 300/1, 2, 10, 11, 300/17, 19, 21

[56] References Cited

U.S. PATENT DOCUMENTS

| | | | |
|---|---|---|---|
| 924,194 | 6/1909 | Schwartz | 300/11 |
| 3,279,858 | 10/1966 | Parker | 300/11 |
| 3,306,670 | 2/1967 | Zahoransky | 300/11 |
| 3,614,165 | 10/1971 | Ebser | 300/10 |
| 3,667,809 | 6/1972 | Fulcher | 300/11 |
| 4,768,837 | 9/1988 | Boucherie | 300/10 X |
| 5,683,146 | 11/1997 | Falleiros et al. | 300/11 X |
| 5,690,394 | 11/1997 | Boucherie | 300/21 X |

FOREIGN PATENT DOCUMENTS

| | | | |
|---|---|---|---|
| 78569 | 5/1983 | European Pat. Off. | 300/21 |
| 195134 | 9/1986 | European Pat. Off. | 300/2 |
| 563419 | 10/1993 | European Pat. Off. | 300/21 |
| 648 448 | 4/1995 | European Pat. Off. . | |
| 2600303 | 7/1977 | Germany | 300/11 |
| 92/17092 | 10/1992 | WIPO . | |
| 92/17093 | 10/1992 | WIPO . | |
| 96/02165 | 2/1996 | WIPO . | |
| 97/07707 | 3/1997 | WIPO . | |

*Primary Examiner*—Mark Spisich
*Attorney, Agent, or Firm*—Richard J. Ancel; Henry S. Goldfine

[57] ABSTRACT

Methods and machines are disclosed to attach tufts of individual bristles to a toothbrush with a resiliently flexible head, wherein the flexible head may be segmented with joints connecting adjacent segments or it may be angled or curved or combinations thereof, and to then trim such tufts of individual bristles to a desired length—or lengths in the case of brushes with multi-level tufts—and to then round the free ends of the individual bristles in each such tuft. The disclosed method and apparatus require only the modification of conventional toothbrush tufting machines having tuft insertion tools that travel in a defined direction and the modification of conventional trimming machines and methods. In particular, the present invention discloses novel apparatus and a method to hold securely a deformed resiliently flexible curved or angled toothbrush head or a segmented resiliently flexible head at the tufting apparatus in a configuration such that the bristle-receiving holes lie substantially parallel to the direction of travel of the tuft insertion tool, and at the trimming and end rounding portions of a toothbrush finishing machine so that conventional tufting, trimming and end rounding machines and methods can be used in the manufacture of such brushes.

18 Claims, 12 Drawing Sheets

METHOD AND APPARATUS TO PERMIT ATTACHMENT OF BRISTLES TO TOOTHBRUSHES WITH RESILIENTLY FLEXIBLE HEADS AND TO THEREAFTER PERMIT THE TRIMMING AND END ROUNDING OF SUCH BRISTLES

BACKGROUND OF THE INVENTION

1. Field of the Invention

This invention relates to a method and apparatus to permit attachment of tufts of individual bristles to toothbrushes with resiliently flexible, angled or curved heads and to then permit the trimming of such tufts of individual bristles to a desired length—or lengths in the case of brushes with multi-level tufts—and to then permit the rounding of the free ends of the individual bristles in each such tuft, which method and apparatus require only the modification of conventional toothbrush tufting and trimming machines and methods.

In particular, the present invention discloses novel means to deform and hold securely the head of a resiliently flexible, angled toothbrush at the tufting apparatus in order align the longitudinal axes of the tuft holes in a direction generally parallel to the direction of travel of the bristle insertion tool and to deform and hold securely the head of such a brush at the trimming and end rounding stations of a toothbrush finishing machine so that conventional tufting, trimming and end rounding machines and methods can be used in the manufacture of such brushes by the modifications according to the present invention. In many instances, the deformation results in the flattening of the head. Following completion of the tufting and then the finishing operations, when the brush is removed from the clamping means, the head returns to its original configuration.

2. Description of the Prior Art

Toothbrushes with curved or angled bristle tip configurations that offer improved access to hard-to-reach areas such as the lingual surfaces of the front teeth, and behind the rear molars, placing more bristles in contact with the outer surfaces of the front teeth are well known in the art. However, many current brushes which have rigidly mounted bristles and a rigid curved or angled bristle surface exhibit an inherent disadvantage when brushing both flat as well as concave tooth surfaces because placing a curved or angled bristle surface on flat tooth surfaces results in fewer bristles making contact with the teeth. These fewer bristles must support the brushing forces applied through the handle, which will result in premature splaying of the bristles. Some toothbrushes have a "power tip" configuration (elongated rigidly mounted tip bristles) which are claimed to have improved access benefits. Such brushes are illustrated in WO 94/09678; GB 304,459; U.S. Pat. No. 1,639,880, and U.S. Pat. No. 4,800,608, the teachings of which are incorporated herein in their entirety. Thus, while fixed angled or curved heads offer improved access to difficult-to-reach areas, because of their shortcomings with respect the brushing of flat tooth surfaces, it would be desirable to have an angled or curved brush head that flexes back to a flattened position when the brush is subjected to typical brushing forces.

Toothbrushes having heads with fixed angles or curves present another problem as well in their manufacture, particularly with respect to the attachment of tufts and the finishing thereof. Conventional toothbrush tufting machines operate in two axes, but the curved or angled section of the head does not lie within the area of operation of the tufting tool. Therefore, it becomes necessary to rotate the brush to a new position in order to bring the bristle-receiving face into the correct position in which the tufting tool can insert the bristles. While modern machines exist that can tuft brushes with other than flat bristle-receiving surfaces because both the brush and tufting tool can rotate, such machines are expensive. It is also known that conventional tuft drivers can insert bristles in an angled tuft hole provided that the angle is limited, generally to 6 degrees or less, by use of an angled tuft pin that is inserted straight and the driver, made of a thin piece of flexible metal, simply bends as the bristles follow the direction of the tuft hole. Nevertheless, it is desirable to have the capability of attaching tufts of bristles to toothbrushes with flexible angled or curved heads and of trimming such tufts of bristles to a desired length—or lengths in the case of brushes with multi-level tufts—and of then rounding the free ends of the bristles, which requires only the modification of conventional toothbrush tufting and trimming machines and methods.

Toothbrushes that include heads having pivoting or articulated sections joined together in a variety of constructions, such as by hinged articulated sections, are well known in the art.

For example, WO 92/17093, the teachings of which are incorporated herein in their entirety, discloses a toothbrush in which the head is divided by one or more hinge-forming grooves in the side of the head opposite to the bristle-bearing side into at least two segments that are flexibly and resiliently linked to each other and/or to the toothbrush handle. The head of such brush is flat, however.

WO 96/02165, the teachings of which are incorporated herein in their entirety, discloses toothbrushes with resilient, flexible heads, certain embodiments of which are similar to those shown in WO 92/17093. One embodiment has a curved head in the unstressed position and is formed by an elastomer-covered thin extension of the handle material. However, the specification merely states that the "Cutting and end-rounding of the bristles can be done using any of the methods commonly known in the art." No specific information is given, and the other embodiments disclose brushes with flat heads. WO 97/07707, the teachings of which are incorporated herein in their entirety, discloses a toothbrush in which the flexibility of the head is concentrated in the tip of the head, the head being angled at the tip. While this publication discloses that the hard plastic skeleton is made by injection molding, wherein the bristle face is substantially flat, and the tip region is subsequently folded to a desired angle with the base region, following which the elastomer is injected at a link region between the two segments, it simply teaches that the bristle are ". . . inserted by a conventional process . . . ." Again, no specific method or apparatus is disclosed to tuft, trim and end round the bristles of a flexible headed toothbrush, wherein at least a portion of the head may be at an angle with respect to the balance of the head.

Co-pending U.S. application Ser. No. 08/762,783, U.S. Pat. No. 5,758,383, the teachings of which are incorporated herein in their entirety, discloses a toothbrush having a resiliently flexible, angled head, but no specific teaching is present with respect to the tufting, trimming and end rounding operations.

EP 0 078 569 and U.S. Pat. No. 5,165,761, the teachings of which are incorporated herein in their entirety, each disclose the end rounding of toothbrushes with multi-level bristles, but the bristle faces are flat.

Toothbrushes having flexible angled or curved heads do not fit well into existing clamps of conventional tufting and finishing machines. The bent or curved head can slip out of, or be folded inwardly in the case of segmented brush heads, by typical clamps.

OBJECTS OF THE INVENTION

It is an object of this invention to provide means and a method to attach bristle filaments to a toothbrush having a resiliently flexible head selected from the group consisting of angled heads, curved heads, segmented heads with joints connecting adjacent segments, and combinations thereof and to then trim such filaments to desired lengths and subsequently round the free ends of such filaments on conventional toothbrush tufting and finishing (trimming and end rounding) equipment.

SUMMARY OF THE INVENTION

In accomplishing the aforementioned objectives, the present invention provides a means and method pursuant to which a segmented resiliently flexible head is secured or an angled or curved head of a flexible headed toothbrush is deformed and then, on an otherwise conventional tufting and finishing machine, the so secured and/or deformed head is secured in a configuration and position to permit the use of conventional tuft insertion tools, trimmers, including rotary cutters, and end-rounding devices, including orbital sanders. The clamping means comprises an auxiliary head engaging device on each tufting clamp on the tufting machine, and a head supporting device on the clamp that holds the brush on the finishing machine, which device prevents the head from buckling and holds the head, in conjunction with conventional clamping or holding means, in at least a flat configuration during the trimming and end-rounding operations. The auxiliary head engaging device at the tufter is generally stationary, and it may also be stationary at the finishing equipment. However, as will be discussed below, the head supporting device at the finishing equipment may be capable of piston-like movement and take a head of concave configuration and deform same to a flattened configuration or continue its movement to result in a convex head configuration. The result of such additional movement is that the bristle tips may be cut in such a way as to result in a variety of bristle trims despite the fact that the conventional cutting and end rounding devices, which oscillate essentially along a straight, horizontal line and work best on conventional brushes with rigid flat heads, may be used to achieve such varying bristle trim patterns.

DETAILED DESCRIPTION OF THE INVENTION

The present invention discloses a method and machines to attach bristle filaments to a toothbrush having a resiliently flexible head and to then trim such filaments to desired lengths and subsequently round their free ends on conventional toothbrush tufting and finishing equipment. It will be understood that the designation "flexible head" includes segmented heads with joints connecting adjacent segments, whether flat or not, as well as flexible heads that are angled or curved and combinations thereof. Subsequent designations of angled brush heads herein shall be interpreted to include flexible and curved brush heads as well. In addition, in all cases, the flexible head is resilient, so that when an applied force, whether from brushing or from clamping, is removed, the flexible head returns to its original configuration. Thus, it is to be understood that the methods and machines disclosed herein are relevant to all such types of flexible headed toothbrushes.

Figure 1:
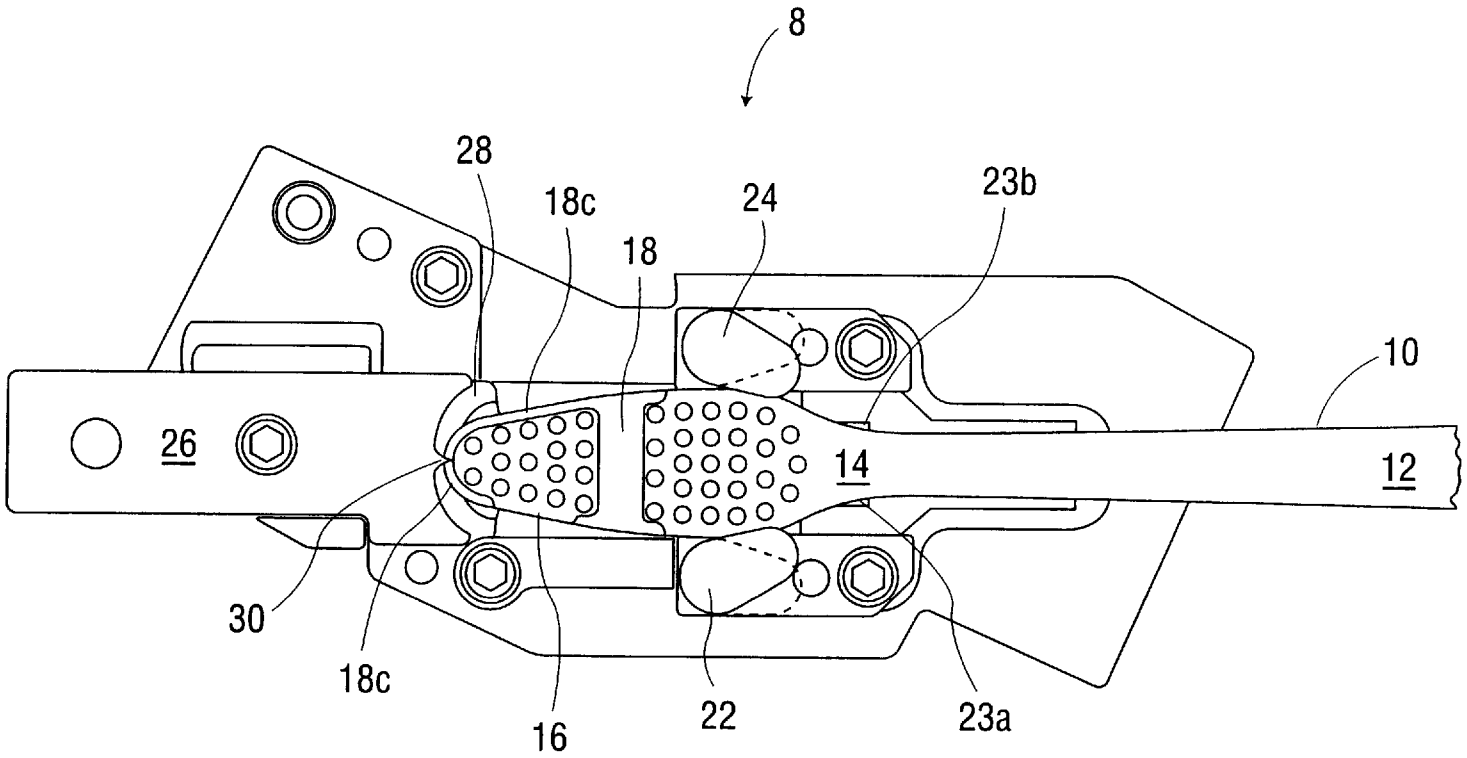
FIG. 1 is a top plan view of a brush clamp used in a conventional tufting machine and a multi-component, resiliently flexible, filament-free, angled toothbrush head, prior to tuft insertion, which illustrates the modification that securely engages the free front end of the head.

Referring now to FIG. 1, there is shown a simplified top plan view of a brush clamp 8 used in a conventional tufting machine. A portion of a two-component, resiliently flexible, angled untufted toothbrush handle and head 10 is shown, ready for tuft insertion. The brush handle is fed to the tufter by a handle feeder, which is not shown since it is conventional and unrelated to this invention. The feeder, however, would include means to deform the brush head to a desired configuration as the head is inserted into clamp 8 and the clamping means discussed hereinafter are actuated.

The brush consists of handle section 12 (not completely shown), which connects to rear head section 14 and free head section 16, flexibly and resiliently connected to each other by a thin bridge (not shown), which is beneath elastomeric material 19. The bridge results in a groove being formed between the thus segmented sections of the head. It should be understood that there can be one or more grooves on the head, which grooves can be linear or non-linear, oriented transversely or longitudinally or both with respect to the longitudinal axis of the head, and flush with the upper or lower surfaces of the brush head or somewhere in between. In this embodiment, the elastomer 18 continues around a portion of the periphery 18*c* of the lower surface of section 16. This aspect of the brush, however, is beyond the scope of and is unnecessary to the practice of this invention. The brush head, however, flexes at the hinge section 18. In the completely finished (i.e. tufted, trimmed, and end rounded) brush, the head sections are optimally at an angle of about 15 degrees to each other, but this angle, obviously, could be greater or smaller depending upon the desires of the manufacturer of the brush. A complete description of brushes made in accordance with method and apparatus disclosed herein will be found in copending application filed on even date herewith, 08/881,740. It should be obvious that the term toothbrush includes brush heads for use in either detachable-headed manual brushes or electric or battery operated brushes in which cases the stem portions thereof are equivalent to the toothbrush handles referred to herein.

The handle 12, head sections 14, 16, and bridge are typically molded from a plastic or resin such as polypropylene, although certain grades of nylon polymers may also be used. Preferred polypropylene resins include Huntsman General Purpose Homopolymer No. 5520 and Hostalen Polpropylene PPR 1042 Copolymer. The thermoplastic elastomer which forms elastomeric sections 18–18*e* may be a thermoplastic vulcanate (TPV) consisting of a mixture of polypropylene and EPDM (ethylene propylene diene monomers) (Santoprene brand), or Vyram (brand), another TPV consisting of a mixture of polypropylene and natural rubber, both Santoprene and Vyram (brands) being elastomers marketed by Advanced Elastomer Systems. A preferred elastomer includes Kraton, a brand of styrene block copolymer (SBC) marketed by Shell, and Dynaflex G 2706 (brand), a thermoplastic elastomer marketed by GLS Corporation and which is made with Kraton (brand) polymer.

Brush plate 26 engages the tip of the free end of the brush head by means of an undercut areas 28, which is conventional. This undercut area is generally formed on a conventional tufter by the grinding of the tip engaging wall of plate 26 at a 5 degree angle to thereby result in an overhang of about 0.015". The balance of the brush head may be clamped in place by conventional means, such as by use of bobbins or rotating clamps 22 and 24, shown in solid lines in the holding position and in dotted lines in the open position to allow new brushes to be inserted and tufted brushes to be removed. However, these two clamping means are generally not sufficient to securely hold the angled tip of a flexible multi-component toothbrush head, where the tendency of the angled tip is to return from the deformed or flattened position in this case to the angled position. Hence, plate 26 has now been modified to include auxiliary clamping means in the form of a tip engaging flange or point 30. Thus, the auxiliary clamping means greatly increases the effective length of the overhang resulting from undercut area 28 (to about 0.025" to about 0.065" preferably), and it, along with rotating clamps 22 and 24 and a backing plate described below, is now sufficient to ensure that the deformed brush head is held securely and resists the tendency to return to its angled state, which tendency is magnified by the presence of the elastomeric hinge.

Figure 2:
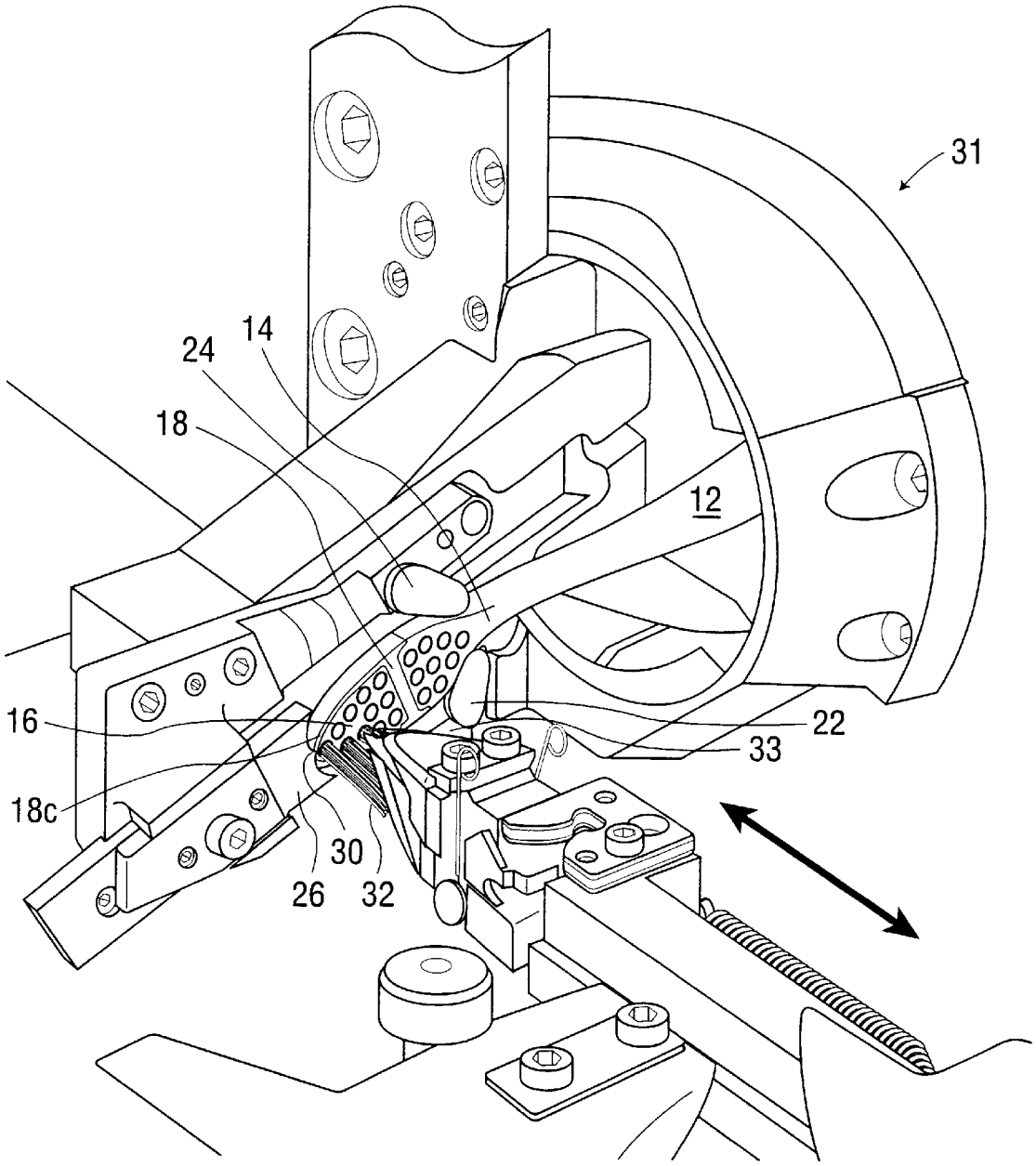
FIG. 2 is an enlarged view of the brush clamp of FIGS. 1 and 1A in the environment of an otherwise conventional tufting machine, with the angled, resiliently flexible toothbrush head flattened and held firmly in place in such configuration as U-shaped tufts of filaments are being inserted into the tuft holes.

It is important to keep in mind that because the brush head must be tufted by means of a conventional tuft insertion tool, illustrated in FIG. 2, which inserts a plurality of U-shaped bristles in each tuft hole secured by a metal staple or anchor at the bight portion of said U-shaped tuft of bristles, it is difficult to add additional means to secure the flexible angled tip in a deformed condition without interfering with the operation of the tuft insertion tool. However, the auxiliary clamping means 30 accomplishes this goal.

Figure 1A:
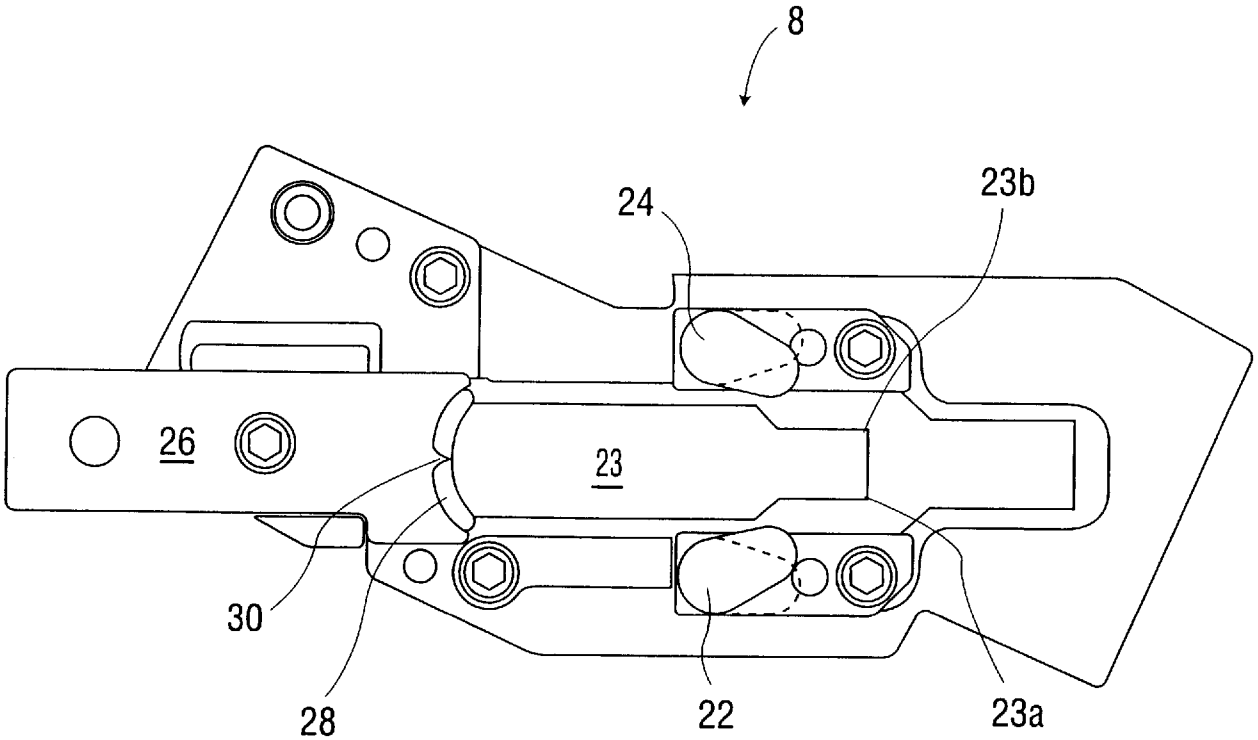
FIG. 1A is a top plan view of the brush clamp of FIG. 1 prior to insertion of the toothbrush body.

The brush rests on a contoured backing plate 23, only the ends 23*a* and 23*b* of which are visible in FIG. 1, but which can best be seen in FIG. 1A. Backing plate 23 is configured and contoured to match the back surface of each particular toothbrush to be tufted. It provides the seat that permits the clamping means to hold the angled head segment, or segments in the case of a multi-segmented brush head, in position such that the tuft holes are substantially parallel to the direction of travel of the tuft insertion tool and resist the tendency to bend the head back to its initial concave configuration seen best in FIG. 5 and FIG. 9. Moreover, this contoured backing plate 23 helps keeps the brush from buckling along each hinge and assuming an even more pronounced concave shape. This combination of a contoured backing plate and rotating clamps helps the originally concave configuration of the brush head to remain in the desired flattened shape of the contoured backing plate. Rotating clamps 22, 24, which are conventional, may have an angled configuration or they may be provided with a corkscrew type configuration to help hold the brush tight against contoured backing plate 23.

In FIG. 2 there is shown the brush clamp 8 of FIGS. 1 and 1A in the context of a simplified view of a tufting machine 31, with the resiliently flexible toothbrush head deformed into a flattened configuration and held firmly in place in such configuration in order to receive the U-shaped tufts of filaments and associated anchors (not visible). In general, it will be understood that in machines used for commercial production, the brush will be molded with integral tuft holes. As seen in FIG. 2, U-shaped tufts of filaments and associated anchors (not visible) are being inserted in the flattened and clamped toothbrush head. As is conventional, the filaments are delivered to the tuft insertion tool by means of a picker (not shown), and the metal staple or anchor is fed from an endless roll of wire (also not shown) which is also delivered to the tuft insertion tool where it is severed to form an appropriately sized staple which is driven into the bight portion of the U-shaped tuft 32 and driven into the tuft hole. A bristle deflector 33 may also be provided to ensure unrestricted access to each tuft hole. The tuft insertion tool 31 oscillates in the direction of the arrow, and it will be appreciated that the brush head is securely clamped in such position that the tuft holes are substantially aligned with the direction of travel of the tuft insertion tool.

Tufting is well known in the art and means to accomplish same, including driving of the staple into the tuft hole, are illustrated in U.S. Pat. No. 532,735; U.S. Pat. No. 1,936,743; U.S. Pat. No. 2,084,345; U.S. Pat. No. 5,590,438; and U.S. Ser. No. 08/692,818 filed 2 Aug. 1996 U.S. Pat. No. 5,724, 697 assigned commonly herewith, the teachings of which are incorporated herein in their entirety.

Figure 3:
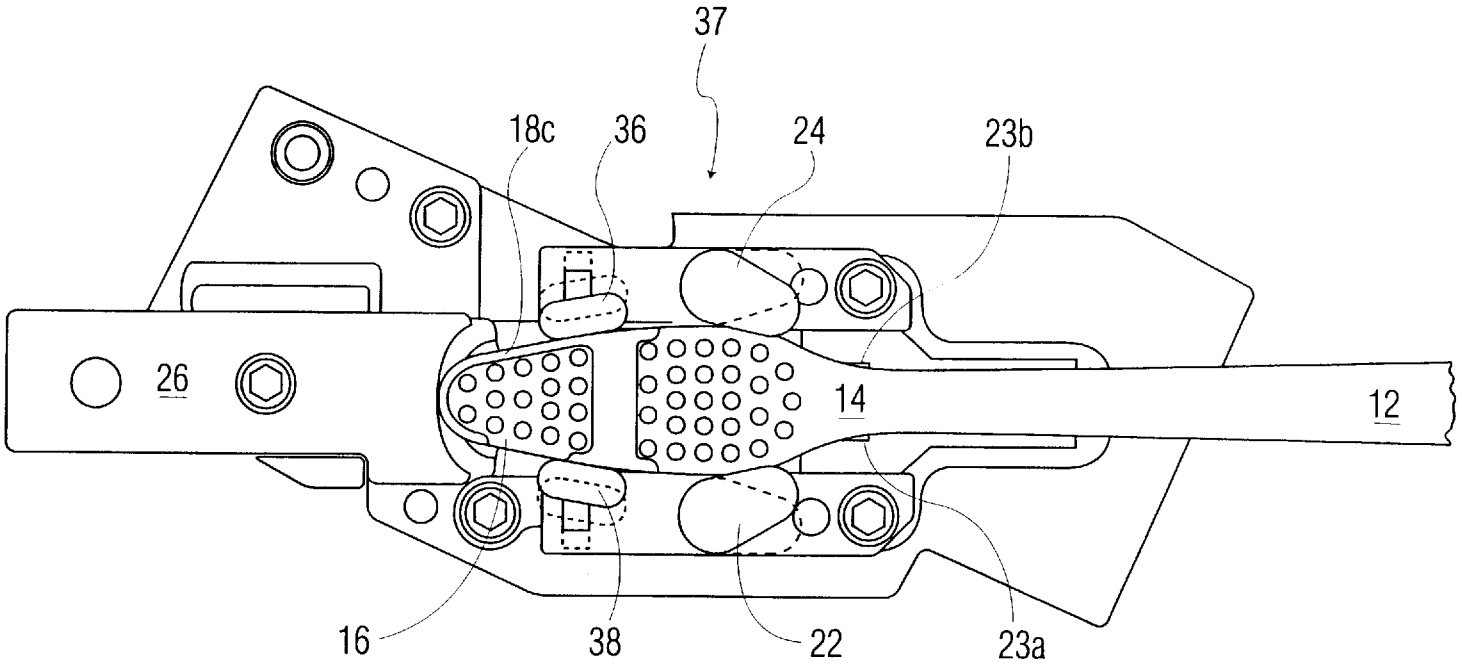
FIG. 3 is a top plan view of a brush clamp and a multi-component, resiliently flexible, filament-free, angled toothbrush head, prior to the tufting operation, similar to FIG. 1, but utilizing a second set of clamps to engage the free front end of the head.

In FIG. 3 is shown a simplified top plan view of a brush clamp and a multi-component, resiliently flexible, angled toothbrush head, prior to tuft attachment, similar to FIG. 1, but utilizing a second set of clamps 36, 38 instead of flange 30 to serve as the auxiliary clamping means to securely clamp the front end of the angled, resiliently flexible head and maintain the flattened position during the tufting operation.

It will therefore be appreciated by these skilled in the art that the improved tufting method and apparatus of this invention, which permits the tufting of angled, resiliently flexible headed toothbrushes on otherwise conventional tufters provides a secure holding device in which three areas of the head are held. The first is the rear portion of the head, held in place by the rotating clamps 22 and 24; the second is the front portion of the head, held in place by undercut area 28 along with tip flange 30 in one embodiment and with rotating clamps 36 and 38 in a second embodiment; and the third is the back portion of the head, held in place by the contoured backing plate 23. Such points of attachment, securely hold the head in place and prevent buckling at the hinged joint during the tufting procedure.

It will also be understood by those skilled in the art that commercial production equipment generally utilizes tufting machines having multiple clamps on a turret, such that the tufting operation is carried sequentially on the brushes retained by such clamps. However, this need not be the case since machines now exist with multiple bristle insertion stations.

Figure 4:
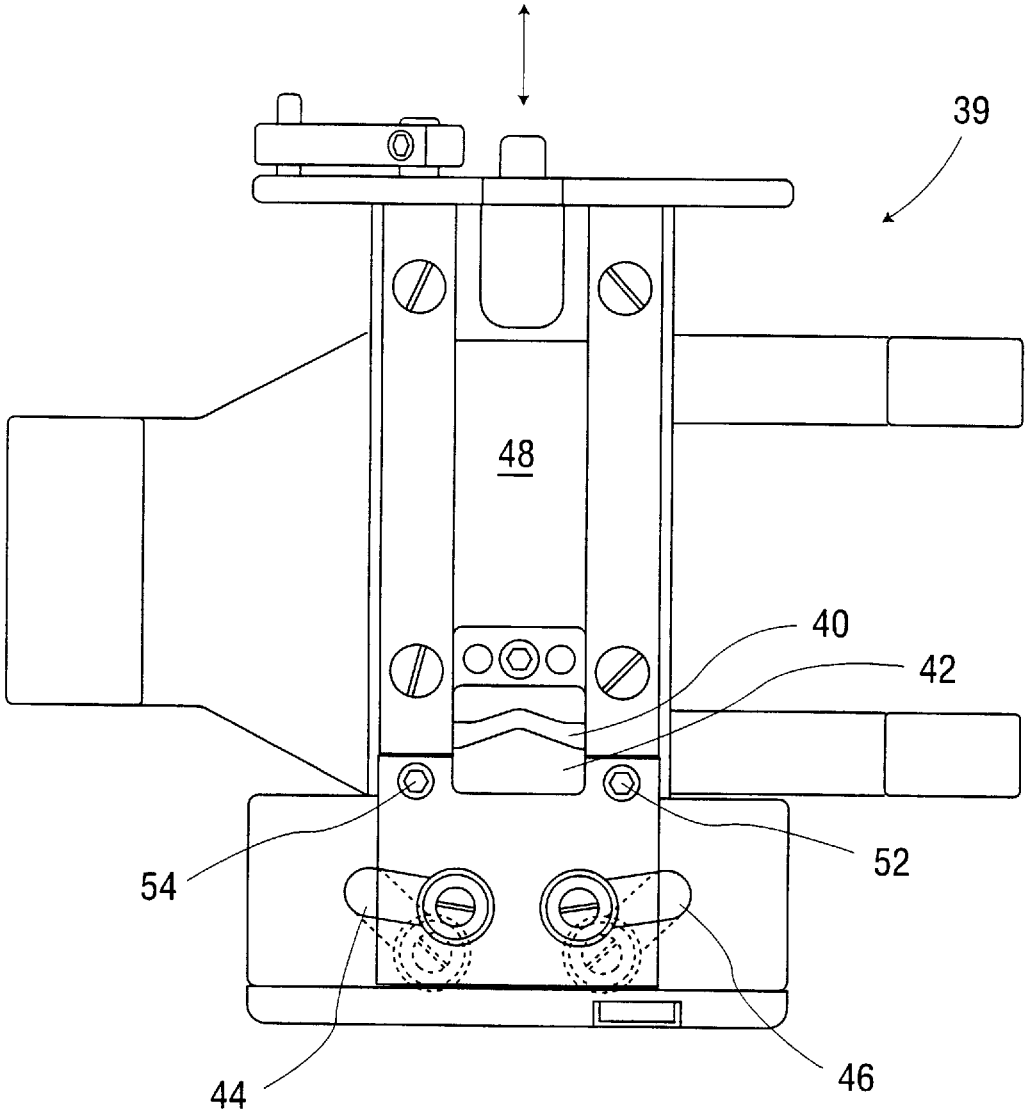
FIG. 4 is a top plan view of a single universal clamp found at the finishing machine, which consists of one or more bristle trimming stations in which the bristle tufts are trimmed to the desired length and one or more end rounding stations.
Figure 7:
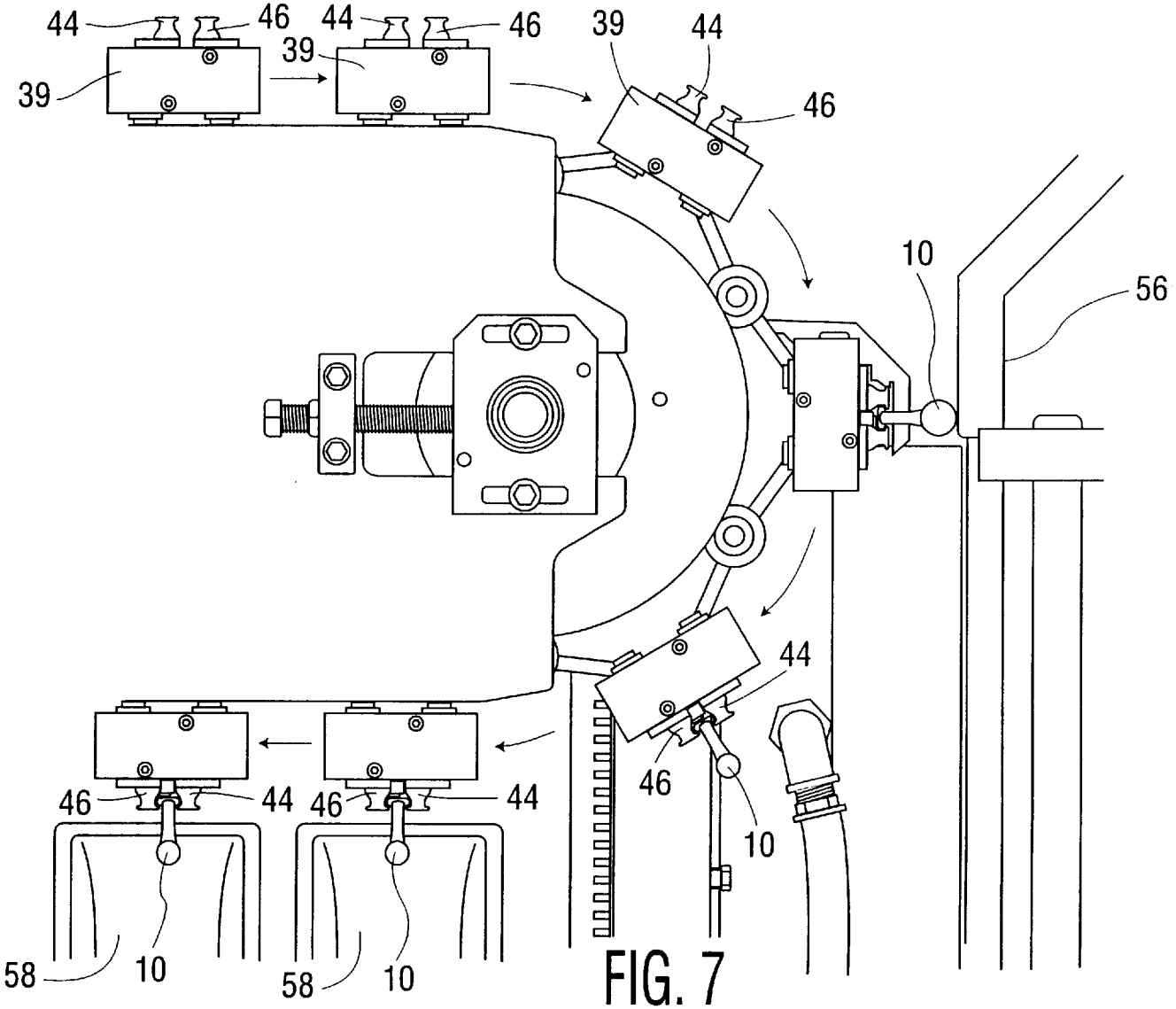
FIG. 7 is a side view of a portion of a finishing machine, individual universal clamps of which are shown in FIGS. 4, 5 and 6 in which the angled, resiliently flexible head of the tufted toothbrush has been flattened and is being carried to the cutting tool (not visible) and then to the end rounding station (not shown).

In FIG. 4 is shown a simplified top plan view of a single universal clamp 39 at a finishing machine illustrated in FIG. 7, which machine houses an endless chain of universal clamps that transport brushes tufted in the tufting machine to bristle cutting or trimming stations, at which the bristle tufts are trimmed to the desired length and end rounding stations, where the free ends of the bristles are rounded by means of the universal clamps 39. Each universal clamp 39 includes a slide member 48, which moves in the direction of the arrow to accommodate brush heads of different sizes. The free end tip of the brush is held by conventional head engaging device 40, which includes an undercut area 42 (also conventional) in which the tip of the toothbrush head fits. The brush (not shown) extends through conventional rotating clamps or bobbins 44 and 46, shown in dotted lines in the open position and in solid lines in the closed position. Screws 52, 54 hold the plate in place. Since the rotating clamps or bobbins 44 and 46 have the "pinched" cylindrical structure best seen in FIGS. 5 and 9, as they rotate to the closed position, they drive the brush head firmly into engagement with head engaging device 40 and undercut area 42.

Figure 5:
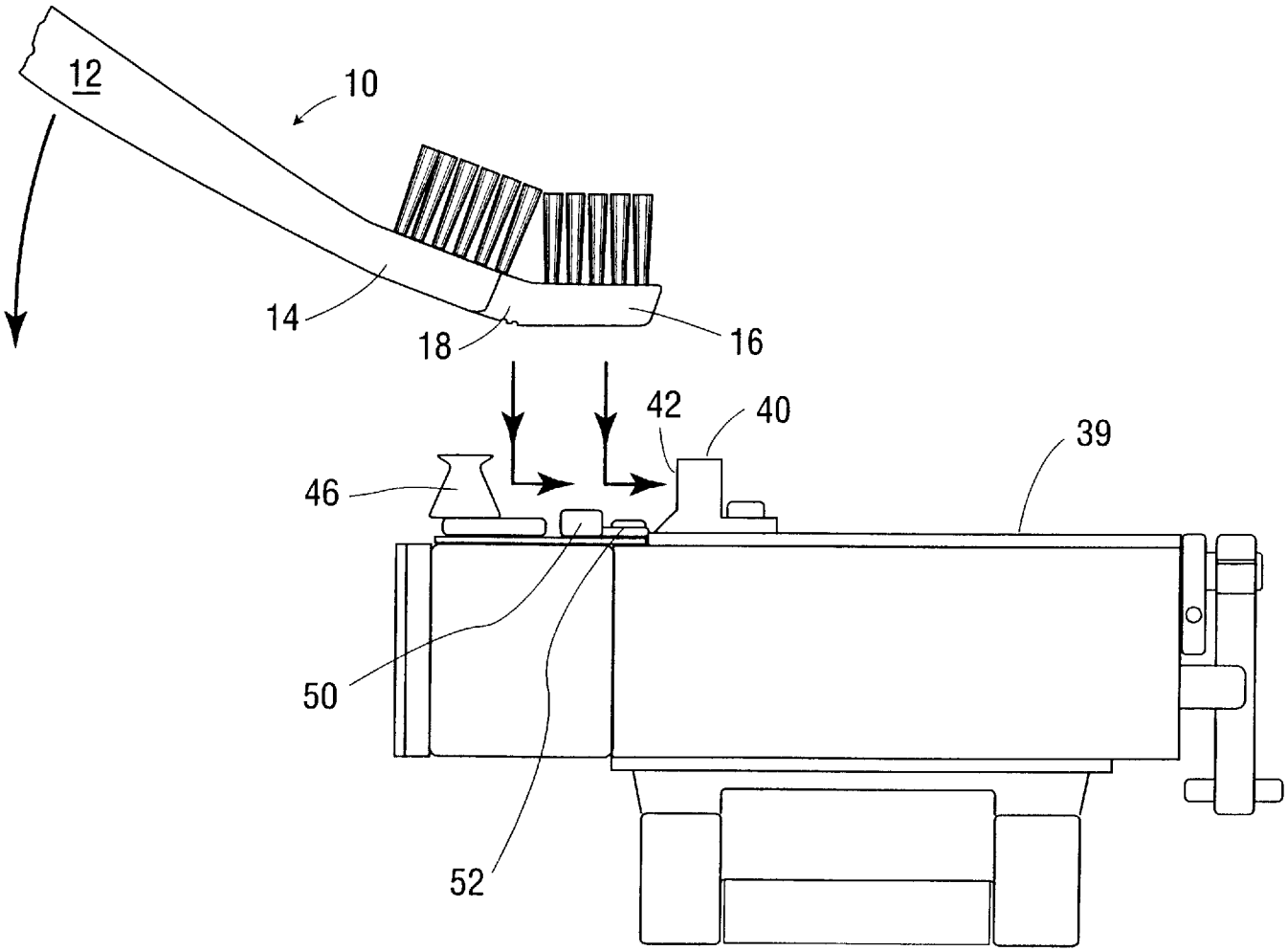
FIG. 5 is a side view of the universal clamp of FIG. 4 in which a tufted toothbrush having a multi-component, resiliently flexible, angled head is being inserted into the clamp.

To prevent the buckling of the resiliently flexible head along its hinge, as the rotating clamps 44, 46 close, a head supporting device 50, as best seen in FIG. 5, which illustrates a simplified side view of a portion of the universal clamp of FIG. 4, is now provided. It will be understood that universal clamps are part of conventional finishing machines. As shown in FIG. 5, a tufted toothbrush 10 having a multi-component, resiliently flexible, angled head is being inserted into the universal clamp 39. Device 50 may be made of plastic or other solid material, and it may be stationary. The choice of material is determined by the toothbrush to be trimmed. If it includes an elastomeric bumper around the head, a material such as a plastic may be selected to avoid damaging or scratching the elastomeric coating. Device 50 must be designed in such manner that it is high enough to become a fourth holding point of the toothbrush head to thereby prevent buckling as the head is subjected to the forces exerted by the cutters and the end rounding devices. It will be appreciated that rotating clamps 44 and 46 provide two holding points and areas 40 and 42 cooperate to provide the third holding point. It will be obvious to those skilled in the art, that if a toothbrush having multiple hinged areas, as shown in WO 92/17093 or WO 96/02165, were to be tufted and trimmed utilizing the method and apparatus of the present invention, device 50 should be large enough to support each such hinge, or multiple devices 50 may be provided to support each such hinge. Thus, it will be recognized that by adding a head supporting device 50 to a conventional universal clamp 39 as used in conventional finishing machines, otherwise conventional finishing machines can now be used to trim and end round the bristles of flexible head toothbrushes with angled portions. Both new machines can be ordered in this way from a machine builder or existing machines can be retrofitted to enable the commercial production of such brushes.

Figure 6:
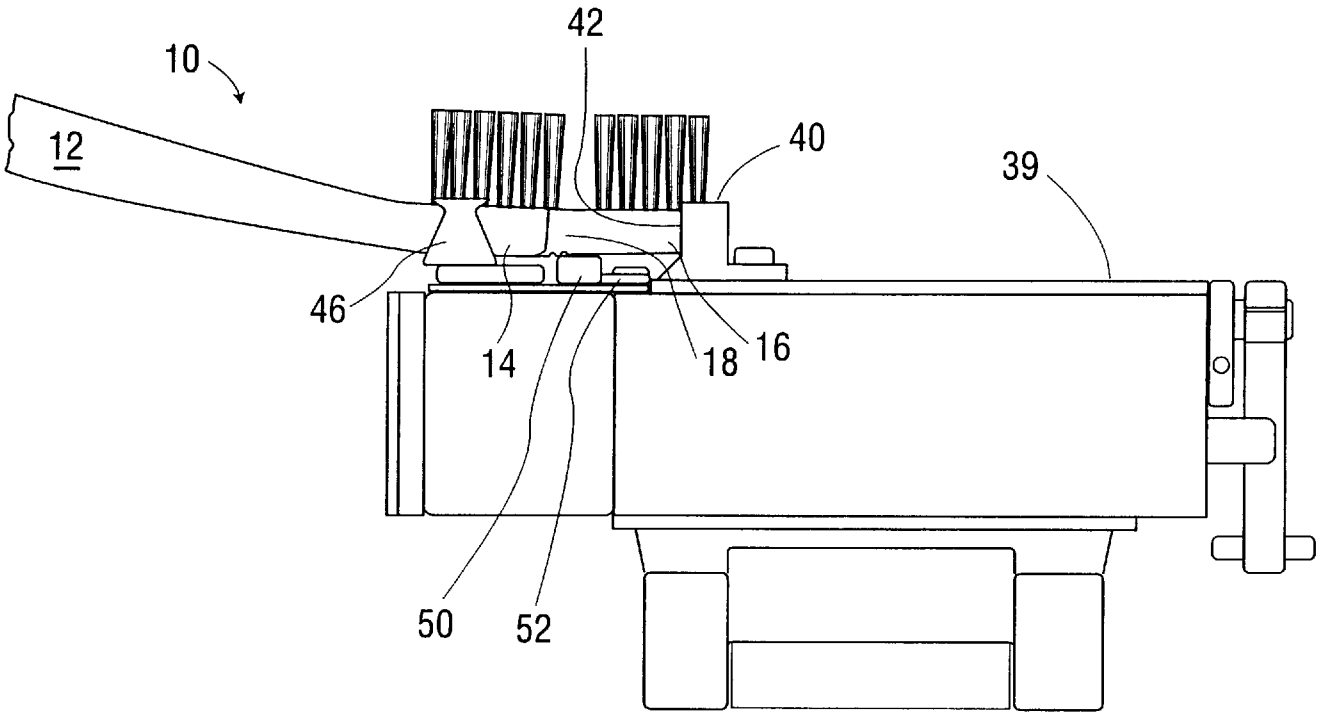
FIG. 6 is a side view of the universal clamp of FIG. 5 in which the head of the tufted toothbrush has been flattened with the use of a stationary head supporting member and held securely to permit trimming or cutting of the bristles to the desired length by a conventional cutting apparatus and subsequent end rounding of the bristle tips.

FIG. 6 provides a side view of the universal clamp 39 of FIG. 5 in which the head of the tufted toothbrush has been deformed to a flattened configuration and secured in such position with the assistance of the stationary head supporting member 50 and held securely by rotating clamps 44 (not visible), 46 and head engaging device 40 including undercut area 42 to thereby permit trimming or cutting of the bristles to the desired length by a conventional cutting apparatus and the end rounding of the bristle tips.

FIG. 7 is a simplified side view of a portion of a finishing machine, comprising a series of universal clamps 39, of the type shown in FIGS. 4, 5 and 6. As shown herein, tufted brushes 10 are fed at 56 from a conventional device which takes tufted brushes from the tufting machine and feeds them to the universal clamp. The angled, flexible head of the tufted toothbrush 10 has been flattened in the universal clamp 39 and is being carried in the direction of the arrows to a (conventional) cutting tool (not shown) at the bottom of FIG. 7, which is found in housings 58. Since the cutting tool is conventional and in widespread use, the details of same are deemed unnecessary here for the practice of the invention. Similarly, the brushes are transported by universal clamps 39 from the cutting stations, still in the direction of the arrows, to the end rounders, which are also not shown for the same reason.

Figure 8:
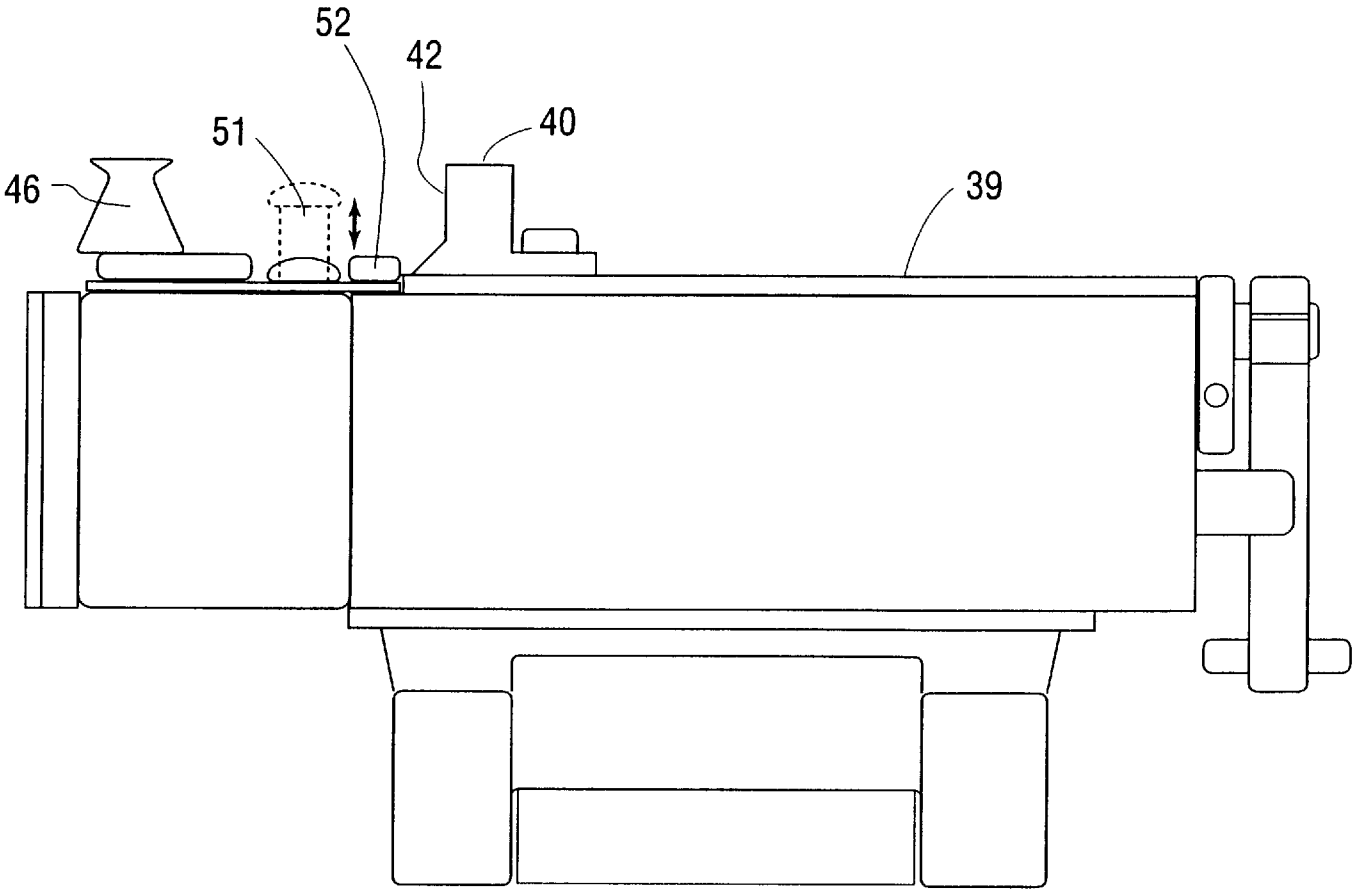
FIG. 8 is a side view of a universal clamp similar to that shown in FIG. 6, but with a movable head supporting member to either help hold the head securely in a flat or convex configuration to thereby permit trimming or cutting of the bristles in each head segment to the desired length by a conventional cutting apparatus and to subsequently permit the end rounding of the bristle tips.
Figure 12:
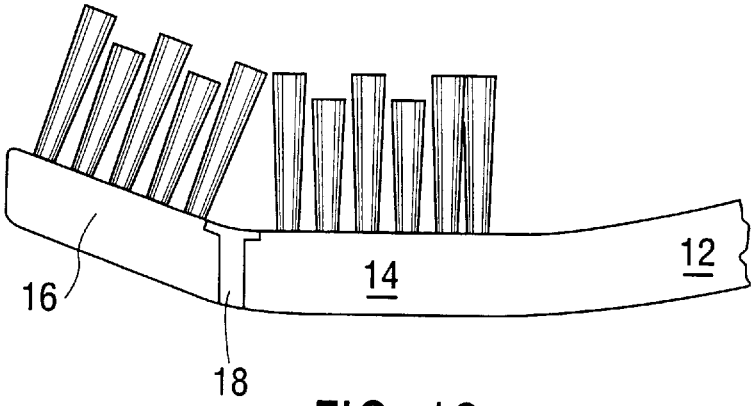
FIG. 12 illustrates a second bristle configuration that can result from the cutting and end rounding steps carried out in accordance with FIG. 10.
Figure 13:
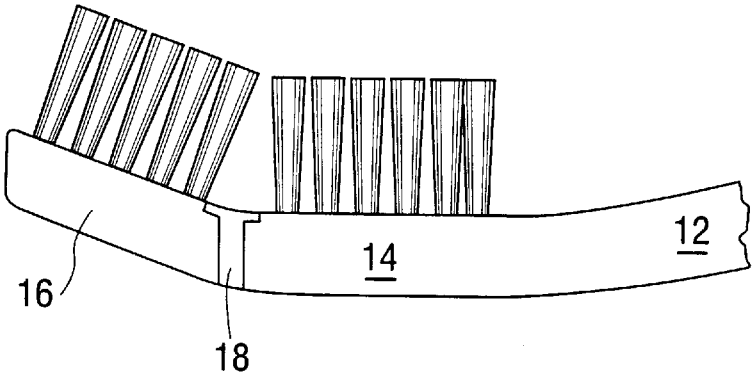
FIG. 13 illustrates a third bristle configuration that can result from the cutting and end rounding steps carried out in accordance with FIG. 10.

FIG. 8 is a side view of a the universal clamp 39 similar to that shown in FIG. 6, but with a movable head supporting member 51, which can hold the head securely in a flat configuration when it is in the lowered position or force the head to flex into a convex configuration when raised to thereby permit trimming or cutting of the bristles in each head segment to the desired length by a conventional cutting apparatus. When the brush head is flat, the cutter will trim the bristles to a flat trim, as best seen in FIG. 13. If desired, by use of technology similar to that shown in EP 0 078 569, a brush can be tufted with rows of bristles, some of which are taller than others, as illustrated in FIG. 12 herein. This is accomplished by a device that is unrelated to the practice of this invention, but is based on technology similar to that disclosed in EP 0 078 569.

Figure 9:
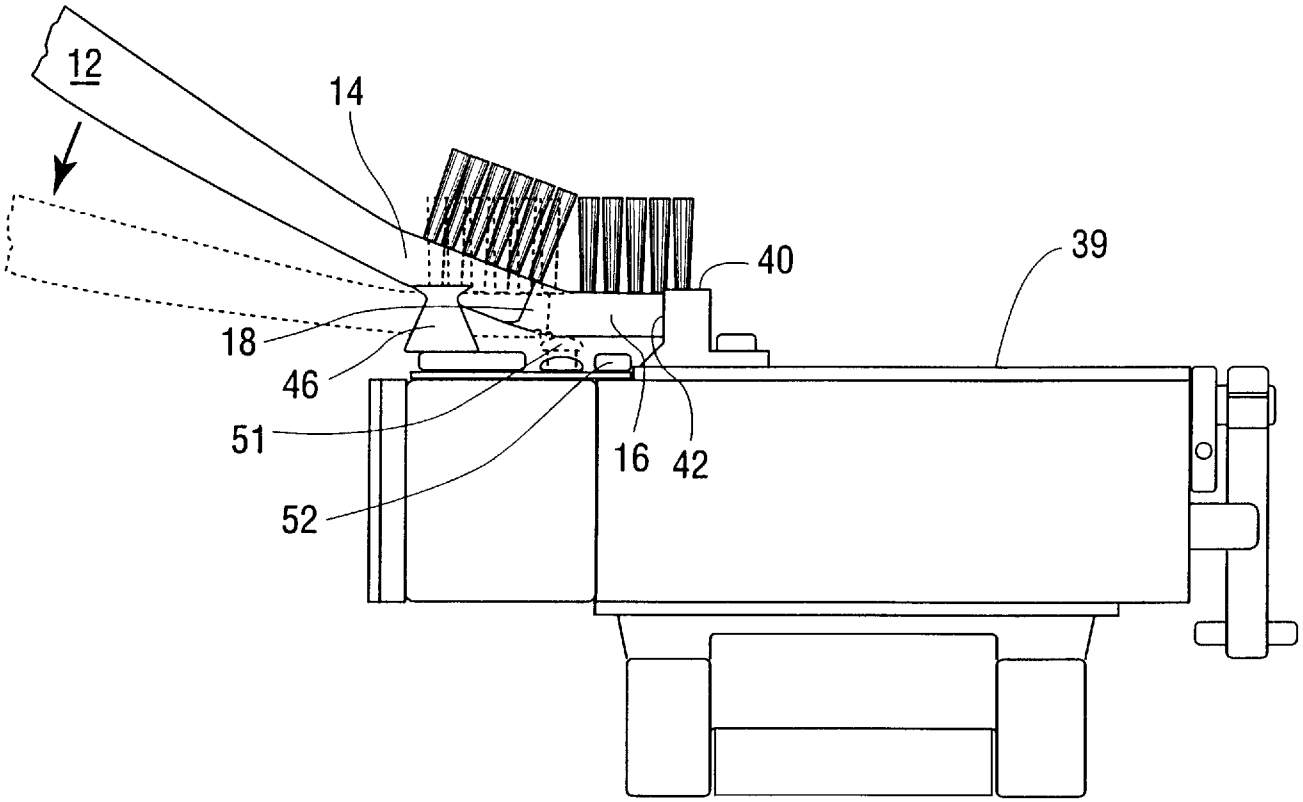
FIG. 9 is a side view of the trimming station shown in FIG. 8, illustrating the insertion of the toothbrush with a flexible head having an angled portion.

FIG. 9 is a side view of the universal clamp 39 shown in FIG. 8, illustrating the insertion of the toothbrush 10 with a segmented, resiliently flexible head having an angled portion 16 as a result of hinge 18. Initially, the brush has the configuration shown in solid lines, but is forced into the flattened configuration shown in dotted lines by the feeding device in conjunction with the rotating clamps 44 (not visible) and 46, which rotate to the closed position and head engaging device 40 and undercut area 42 and is supported in the hinge area 18 by movable head supporting member 51, seen in dotted lines in its elevated position.

Figure 10:
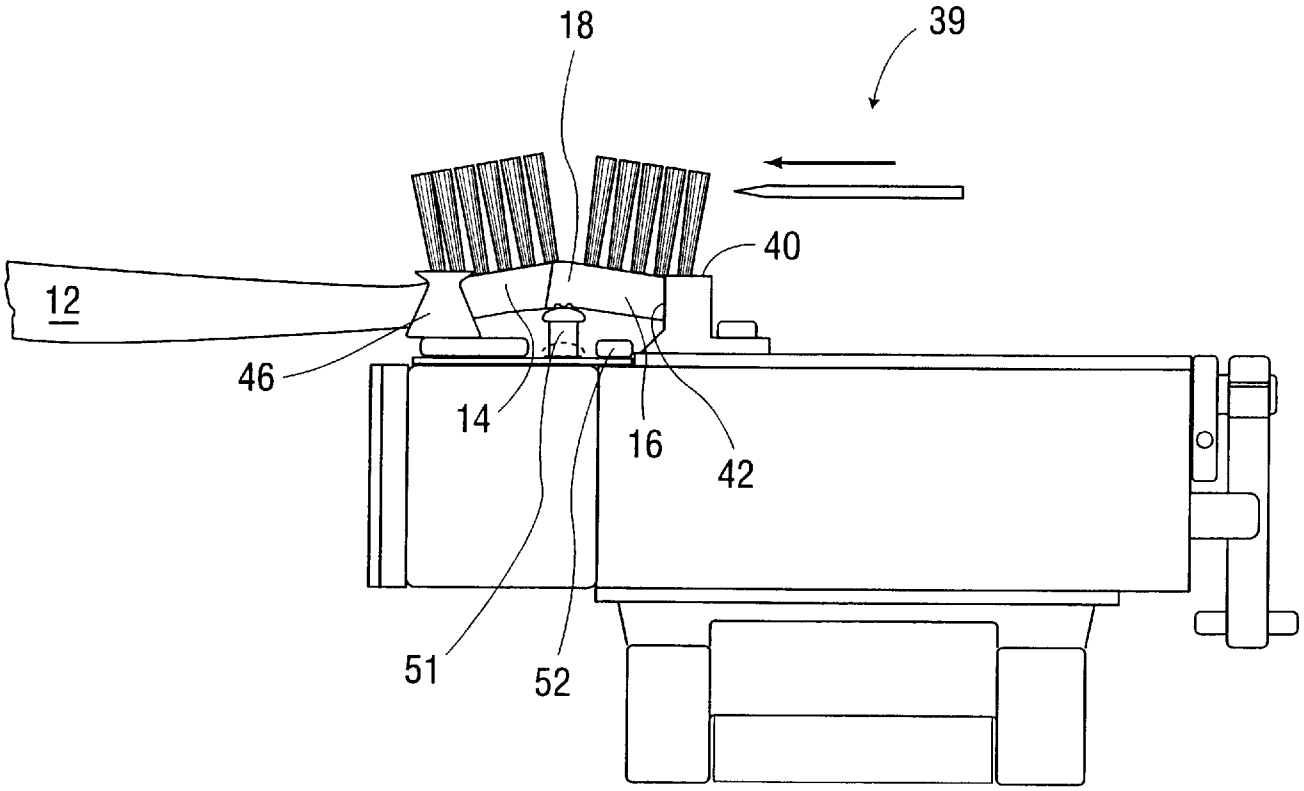
FIG. 10 is a side view of the universal clamp shown in FIG. 9, illustrating the movable head supporting member being raised to form a convex configuration between the segments, so a conventional cutting tool, such as a rotary cutter, oscillating in a generally straight line, can cut the bristles to a desired length and conventional end rounders, such as orbital sanders, can operate on the bristle ends.
Figure 11:
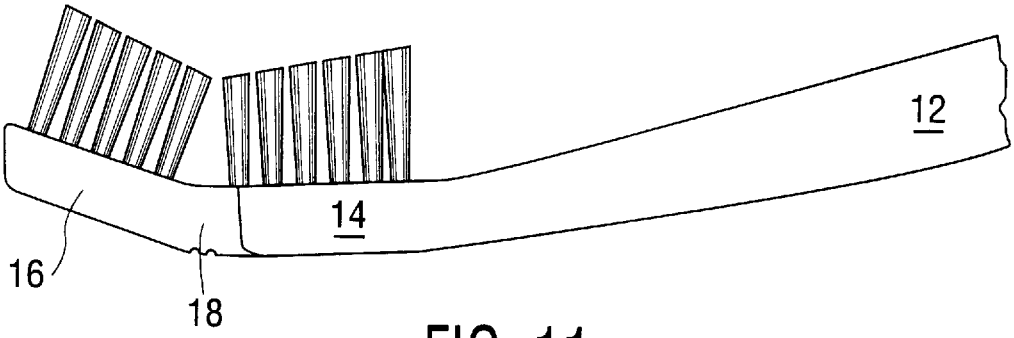
FIG. 11 illustrates one bristle configuration resulting from the cutting and end rounding steps carried out in accordance with FIG. 10.

FIG. 10 is a side view of the universal clamp 39 shown in FIG. 9, illustrating the movable head supporting member 51 being raised to form a convex configuration between the head segments 14, 16, so a conventional cutting tool, oscillating in a straight line, can cut the bristles to a desired length. Conventionally, a cutting tool consists of a series of rotating blades that interact with a stationary blade in a housing which oscillates back and forth, generally in a horizontal direction. As the toothbrush passes over each cutter, it is traveling in a straight line, as is the line of cut in view of the oscillating motion. Thus, by use of the present invention, the bristles of a flexible toothbrush head with an angled portion can be trimmed and end rounded on a conventional finishing machine and, in addition, can be given a variety of bristle trim patterns and not be limited to flat trims only. As shown herein, the tips of the bristles in head section 16 lie in the same plane, as do the tips of the bristles in head section 14. As a result of the convex configuration of the head being presented to the cutting tool, the final trim of the bristles in each section will be as shown in FIG. 11.

Although the cutting tool has oscillated in a substantially straight, horizontal line, since the plane of the bristle tips, originally concave, as shown in FIG. 9, are now presented at an angle (now convex) as shown in FIG. 10, in each head segment of the finished brush 14, 16, the bristles graduate in length from short at the hinge area 18 to tall as they approach their respective ends of the head. FIG. 12 illustrates another possible bristle configuration, while FIG. 13 illustrates a brush with flat trimmed bristles.

It will therefore be seen by those skilled in the art that the improved method and apparatus of this invention relating to the bristle trimming and end rounding operations, which permits the trimming and end rounding of bristles attached to resiliently flexible headed toothbrushes on otherwise conventional finishing machines provides a secure holding device in which, as in the improved brush clamp of this invention in the tufting operation, three areas of the head are held. The first is the rear portion of the head, held in place by the rotating clamps 44 and 46; the second is the front portion of the head, held in place by head engaging device 40, which includes an undercut area 42; and the third is the back portion of the head where the hinge is present, which is held in place by a spacing device, such as 50 or 51. Such points of attachment, securely hold the head in place and prevent buckling at the hinged joint during the trimming and end rounding operations.

While particular embodiments of the present invention have been illustrated and described, it will be obvious to those skilled in the art that it is not to be limited thereto and that variations and modifications can be made without departing from the scope of the present invention, and the appended claims are intended to cover all such modifications within the scope and spirit of the invention.

What is claimed is:

1. A clamping apparatus to permit the attachment, in an otherwise conventional tufting machine including a tuft insertion tool that oscillates in a defined direction of travel, of tufts of bristles to the head of an untufted toothbrush containing a plurality of tuft-receiving holes comprising a handle and a resiliently flexible head attached thereto, said flexible head selected from the group consisting of angled heads, curved heads, segmented heads with joints connecting adjacent segments, and combinations thereof, said head having a front portion including a free tip end, a back end adjacent said handle, an upper surface, and a bottom bristle-receiving surface, said clamping apparatus including means to hold said head securely in a configuration in which said bristle-receiving holes lie substantially parallel to the direction of travel of said tuft insertion tool and to prevent the buckling of said head while said bristles are inserted, said clamping apparatus comprising:

a) a brush plate having a first means to releasably engage the tip of the free end of said brush head;

b) rotating clamp means to releasably engage the portion of said brush head closest to said handle;

c) a backing plate designed to firmly seat the upper surface of said brush head; and d) auxiliary means to releasably engage the front portion adjacent the free end of said brush head.

2. The clamping apparatus of claim 1, wherein said first means on said brush plate is an undercut area that releasably engages the tip of the free end of said brush head.

3. The clamping apparatus of claim 1, wherein said auxiliary means is in the form of rotating clamp means to releasably engage the portion of said brush head closest to said free end of the brush head.

4. The clamping apparatus of claim 1 wherein said auxiliary means is in the form of an overhanging flange of extended length which is designed to releasably engage the free tip end of the brush head.

5. The clamping apparatus of claim 4 wherein said auxiliary means is in the form of an extension of an undercut area of said first means on said brush plate.

6. A clamping apparatus to permit the trimming and end rounding, in an otherwise conventional finishing machine which includes at least one cutting tool and at least one end rounding device, of bristles attached to the head of a toothbrush comprising, a handle and a resiliently flexible head attached thereto, said head including a free tip end, said flexible head selected from the group consisting of angled heads, curved heads, segmented heads with joints connecting adjacent segments, and combinations thereof, said head having an upper surface and a bottom bristle-bearing surface, said clamping apparatus including means to hold said flexible head securely in at least a flattened configuration and to prevent buckling of said head while said tufts of bristles are trimmed or cut to a desired length and the free ends of said bristles are end rounded, said clamping apparatus comprising:

a) a head engaging device capable of receiving heads of varying dimension, said device including a first means to releasably engage the tip of the free end of said brush head;

b) rotating clamp means to releasably engage the portion of said brush head closest to said handle; and c) a spacing device of sufficient height to support the upper surface of said brush head to keep said bristle head in at least a flattened position.

7. The clamping apparatus of claim 6 wherein said spacing device is in the form of a stationary block designed to support the upper surface of said brush head.

8. The clamping apparatus of claim 6 wherein said spacing device is in the form of a movable block designed to maintain support of the upper surface of said brush head while forcing the flexible head to flex in a direction such that the angle of exposure of the implanted bristles to said at least one cutting tool and to said at least one end rounding device changes to present a new angle of exposure of said bristles to said at least one cutting tool and to said at least one end rounding device.

9. The clamping apparatus of claim 6 wherein said first means is in the form of an undercut area that releasably engages the tip of the free end of said brush head.

10. The clamping apparatus of claim 6 which clamps said brush head and conveys same in said clamped condition to said at least one cutting tool and then to said at least one end rounding device.

11. A method of clamping the resiliently flexible head of an untufted toothbrush containing a plurality of bristle tuft-receiving holes in an otherwise conventional tufting machine having a tuft insertion tool that oscillates in a defined direction of travel in order to attach tufts of bristles to said head, said brush including a handle attached to said flexible head, said flexible head selected from the group consisting of angled heads, curved heads, segmented heads with joints connecting adjacent segments, and combinations thereof, said head having a front portion including a free tip end, a back end adjacent said handle, an upper surface and a bottom bristle-receiving surface, the method utilizing a clamping apparatus including means to hold said flexible head securely in a configuration in which said bristle-receiving holes lie substantially parallel to the direction of travel of said tuft insertion tool and to prevent the buckling of said flexible head while said tufts of bristles are inserted, said method comprising the steps of:

a) conveying said brush to said clamping apparatus and deforming at least the flexible head of said brush until said flexible head is in a configuration such that said bristle-receiving holes lie substantially parallel to the direction of travel of said tuft insertion tool;

b) bringing the tip of the free end of said brush head into abutment with a brush plate having an undercut area and auxiliary clamp means;

c) firmly seating the upper surface of said brush head on a backing plate; and d) engaging the portion of said brush head closest to said handle with rotating clamp means until said head is immobilized such that said bristle-receiving holes lie substantially parallel to the direction of travel of said tuft insertion tool, whereby said tufting operation may commence.

12. The method of claim 11 wherein said auxiliary clamp means is in the form of an overhanging flange or point designed to releasably engage the free tip end of the brush head.

13. The method of claim 11 wherein said auxiliary clamp means is in the form of rotating clamp means to releasably engage the portion of said brush head closest to said free end of the brush head.

14. A method of clamping the head of a toothbrush comprising a handle and a resiliently flexible head containing a plurality of bristle tufts, said head having an upper surface and a bottom bristle-bearing surface and a free tip end, said flexible head selected from the group consisting of angled heads, curved heads, segmented heads with joints connecting adjacent segments, and combinations thereof, in a conventional finishing machine in order to permit the trimming and end rounding in such conventional finishing machine, which includes at least one cutting tool and at least one end rounding device, the method utilizing a clamping apparatus including means to hold said flexible head of said toothbrush securely in at least a flattened configuration and to thereby prevent the buckling of said flexible head at a joint thereof while said tufts of bristles are trimmed or cut to a desired length and the free ends of said bristles are end rounded, said method comprising the steps of:

a) bringing the tip of the free end of said brush head into abutment with a head engaging device capable of receiving heads of varying dimension;

b) deforming said brush until said flexible head is in at least a flattened configuration;

c) supporting the upper surface of said flexible head with a spacing device of sufficient height to keep said flexible head in at least a flattened position; and d) engaging the portion of said flexible head closest to said handle with rotating clamp means until said flattened head is immobilized, whereby said trimming and subsequent end rounding operations may commence.

15. The method of claim 14 wherein said spacing device is in the form of a stationary block designed to support the upper surface of said brush head.

16. The method of claim 14 wherein said spacing device is in the form of a movable block designed to force said flexible head to flex in a direction other than the originally presented angle of exposure of the bristles to said at least one cutting tool and to said at least one end rounding device and to maintain support of the upper surface of said brush head to thereby change the angle of exposure of the bristles to said at least one cutting tool and to said at least one end rounding device.

17. The method of claim 14 wherein said head engaging device is in the form of an undercut area that releasably engages the tip of the free end of said brush head.

18. The method of claim 14 in which said clamping apparatus conveys said immobilized brush head in said clamped condition to said at least one cutting tool and then to said at least one end rounding device.

* * * * *